US006192727B1

(12) United States Patent
Chien et al.

(10) Patent No.: US 6,192,727 B1
(45) Date of Patent: Feb. 27, 2001

(54) MOLD SEAT ADJUSTING STRUCTURE OF THREAD ROLLING MACHINE

(75) Inventors: Kwei-Chang Chien, Taichung; Steven Lin, Chan Hua Hsien; Sheng-Chung Tseng, Ta-Li, all of (TW)

(73) Assignee: Hoxn Machinery Co., Ltd., Taichung (TW)

( * ) Notice: Subject to any disclaimer, the term of this patent is extended or adjusted under 35 U.S.C. 154(b) by 0 days.

(21) Appl. No.: 09/483,425

(22) Filed: Jan. 12, 2000

(51) Int. Cl.[7] ..... B21H 3/06
(52) U.S. Cl. ..... 72/90
(58) Field of Search ..... 72/88, 90, 469

(56) References Cited

U.S. PATENT DOCUMENTS 375,099 * 12/1887 Rogers ..... 72/90
2,548,137 * 4/1951 Appleton ..... 72/90
3,926,026 * 12/1975 Jackson ..... 72/90
4,229,966 * 10/1980 Jackson ..... 72/90
4,677,837 * 7/1987 Jackson ..... 72/88
5,345,800 * 9/1994 Smith ..... 72/90

FOREIGN PATENT DOCUMENTS

986561 * 1/1983 (SU) ..... 72/90

* cited by examiner

*Primary Examiner*—Daniel C. Crane
(74) *Attorney, Agent, or Firm*—W. Wayne Liauh

(57) ABSTRACT

A thread rolling machine is provided with a structure for adjusting a fixed mold seat of the machine. The structure comprises a first slide plate, a second slide plate mounted slidably on the first slide plate, and a fixed mold angle adjusting mechanism mounted on the second slide plate for adjusting the inclination angle and the blind angle of the fixed mold. The adjusting mechanism comprises an inclination angle adjusting block and a blind angle adjusting block. The blind angle adjusting block is actuated by an adjustment rod to engage in a horizontal displacement, whereas the inclination angle adjusting block is actuated by an adjustment rod to engage in a longitudinal displacement. The fixed mold is so adjusted that it is in an appropriate thread rolling position relative to the movable mold of the thread rolling machine.

7 Claims, 11 Drawing Sheets

C

B

A

MOLD SEAT ADJUSTING STRUCTURE OF THREAD ROLLING MACHINE

FIELD OF THE INVENTION

The present invention relates generally to a thread rolling machine, and more particularly to a mold seat adjusting structure of the thread rolling machine.

BACKGROUND OF THE INVENTION

As shown in FIGS. 1–3, the U.S. Pat. No. 4,677,837 discloses a thread rolling machine comprising an adjustment structure of the fixed mold thereof. The adjustment structure comprises a split thread line, a blind angle, a rolling depth, and an angle of inclination. The split thread line refers to a first slide plate 2 mounted on a machine frame 1 such that the first slide plate 2 is pushed by a threaded rod 3 to move back and forth so as to actuate the thread line of the split movable mold 5 of the fixed mold 4. The blind angle refers to a second rotary plate 6 mounted on the first slide plate 2 such that the second rotary plate 6 is pushed by a threaded rod 7 mounted on the first slide plate 2 to rotate along the first slide plate 2, thereby actuating the fixed mold 4 to adjust the feed angle with the movable mold 5. A third slide plate 8 is mounted on the second rotary plate 6 such that the third slide plate 8 is pushed by a threaded rod 9 of the second rotary plate 6 to move along the left and the right of the second rotary plate 6, thereby actuating the fixed mold 4 to adjust the distance between the fixed mold 4 and the movable mold 5 so as to provide the blank with a required roll depth. The third slide plate 8 is provided with an arcuate machine frame 10 mounted thereon. A slide block 11 is connected with a U-shaped plate 12 which is fastened with the fixed mold 4. The fixed mold 4 is drawn to swivel for adjusting the parallel degree relative to the movable mold 5, so as to attain consistency of the thread form.

In view of the second rotary plate 6 being mounted on the first slide plate 2 for the adjustment of the blind angle, a greater degree of freedom is resulted from the pushing and the turning. As a result, the rigidity is poor. The rotational force on the fixed mold may result in the stress destruction of the second rotary plate 6 and the threaded rod 7. As a result, the adjustment precision is compromised.

SUMMARY OF THE INVENTION

The primary objective of the present invention is to provide a thread rolling machine with a mold seat adjusting structure comprising a first slide plate which is mounted on the machine frame such that the first slide plate is pushed by an adjustment rod to displace back and forth, so as to bring about the split thread line adjustment of the fixed mold. A second slide plate is slidably mounted on the first slide plate such that the second slide plate is pushed an adjustment rod to displace leftward and rightward so as to bring about the rolling depth adjustment of the fixed mold. The second slide plate is fastened with a mechanism for adjusting the angle of inclination and the blind angle of the fixed mold. The mechanism comprises the fixed mold which is provided in the front seat thereof with a semispherical seat which is then mounted on the rear seat of the fixed mold. A threaded rod is put through the fixed mold rear seat and semispherical seat. The semispherical seat allows the universal movement to push directly the threaded rod so as to bring about the angular adjustment of the fixed mold. In order to enable the threaded rod to have a greater pushing reliability, the threaded rod is provided at the rear end thereof with a blind angle adjusting block having a longitudinal slot, and an angle of inclination adjusting block having a horizontal slot. The threaded rod is actuated by the pushing of the blind angle adjusting block and the pushing of the angle of inclination adjusting block to the fixed mold adjusting angle, so as to control the precision of the angle adjustment. As a result, the present invention is capable of adjusting the inclination angle and the blind angle on the angle adjustment mechanism such that the adjustments of the thread line split and the rolling depth are attained by the linear displacements of the first slide plate and the second slide plate, without having to set up the rotary plate to adjust the blind angle as is the case with the prior art. In other words, the rigidity of the mechanism of the present invention is enhanced by means of the linear motion, thereby prolonging the adjustment precision of the present invention.

It is another objective of the present invention to provide a thread rolling machine with a mold seat adjusting structure comprising a mold seat locking mechanism which is mounted on the machine frame under the first slide plate and the second slide plate. A threaded rod is fastened with the machine frame, the first slide plate and the second slide plate such that the threaded rod is provided with an elastic body and a top plate. The first slide plate and the second slide plate are locked on the machine frame by means of the traction of the elastic body. A pressure cylinder is disposed under the top plate for urging a press plate to compress the elastic body, thereby enabling the first slide plate and the second slide plate to be relieved of the locking force.

The foregoing objectives, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
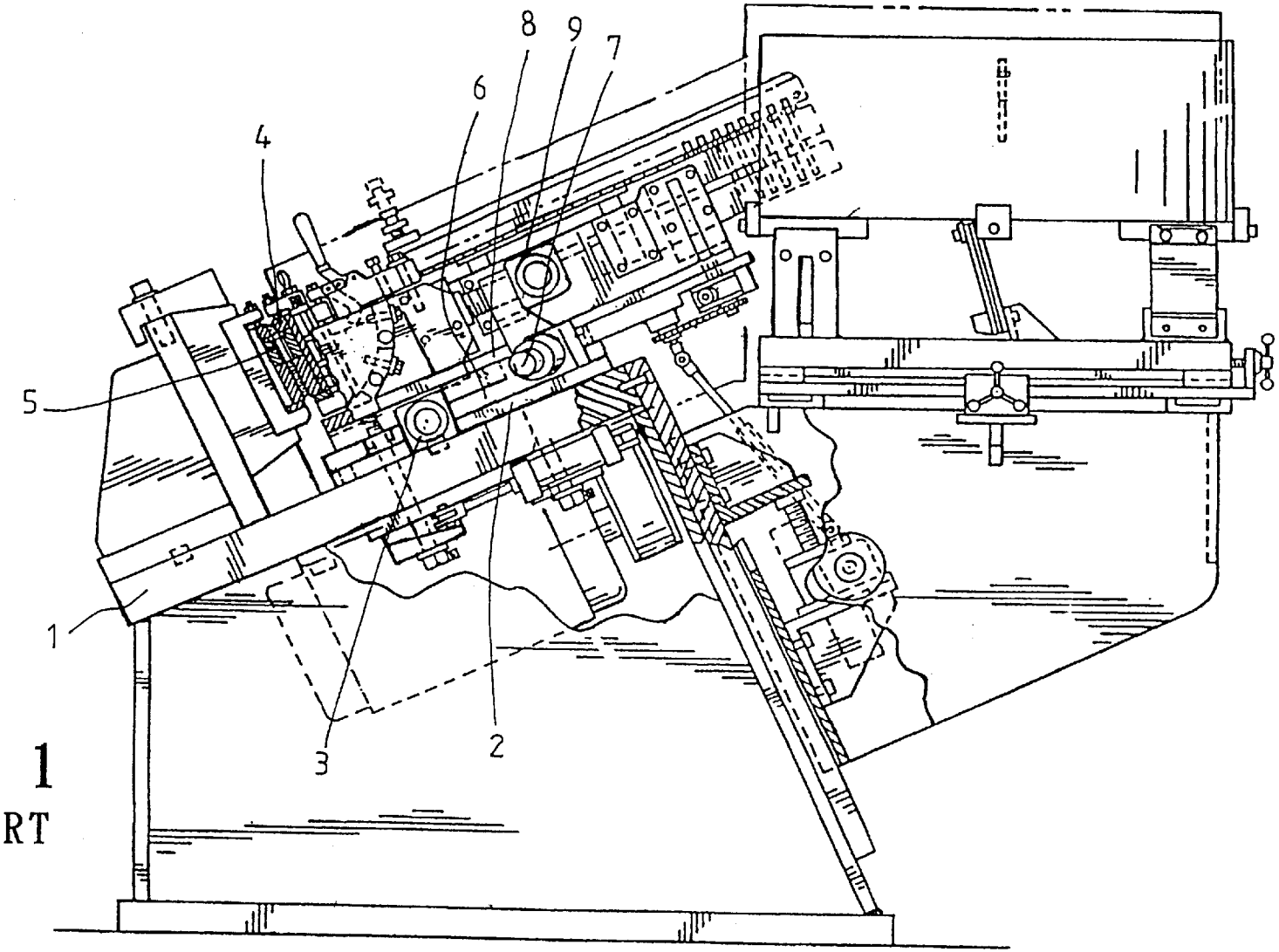
FIG. 1 PRIOR ART
FIG. 1 show a side schematic view of a prior art structure disclosed in the U.S. Pat. No. 4,677,837.
Figure 2:
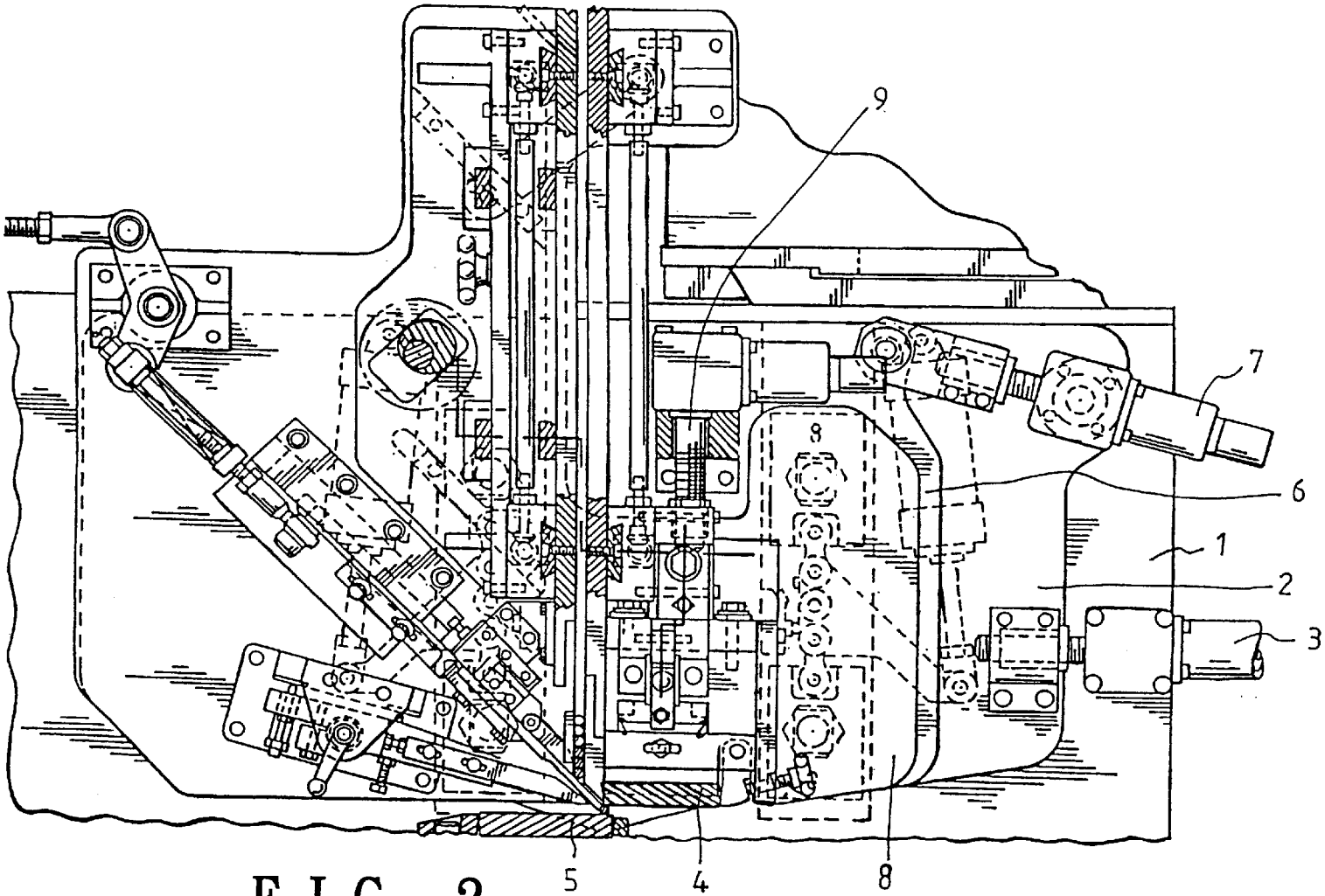
FIG. 2 PRIOR ART
FIG. 2 shows a partial top view of the prior art structure disclosed in the U.S. Pat. No. 4,677,837.
Figure 3:
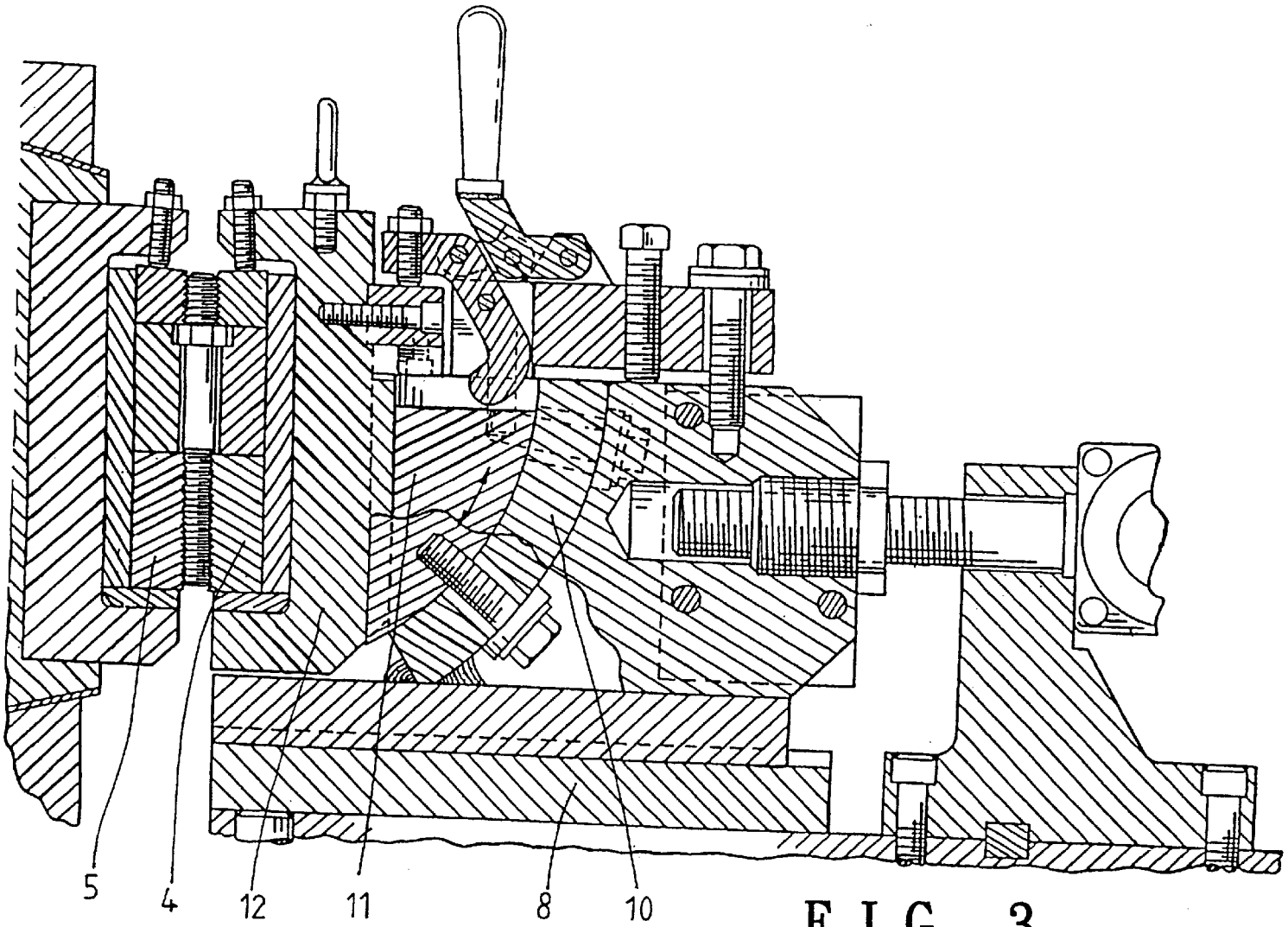
FIG. 3 PRIOR ART
FIG. 3 shows a schematic view of the inclination angle adjustment of the prior art structure disclosed in the U.S. Pat. No. 4,677,837.
Figure 4:
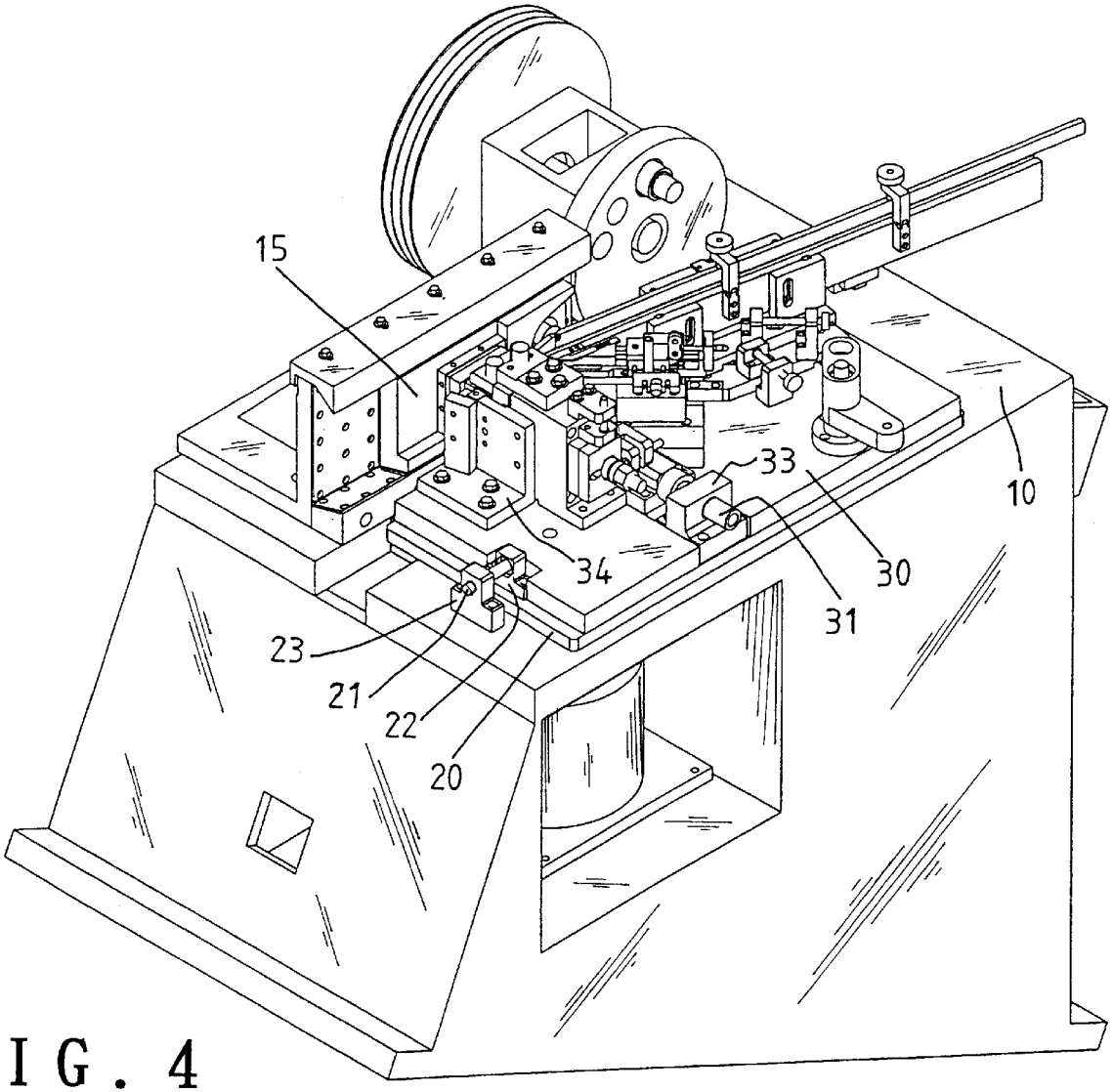
FIG. 4 shows a schematic view of the present invention.
Figure 5:
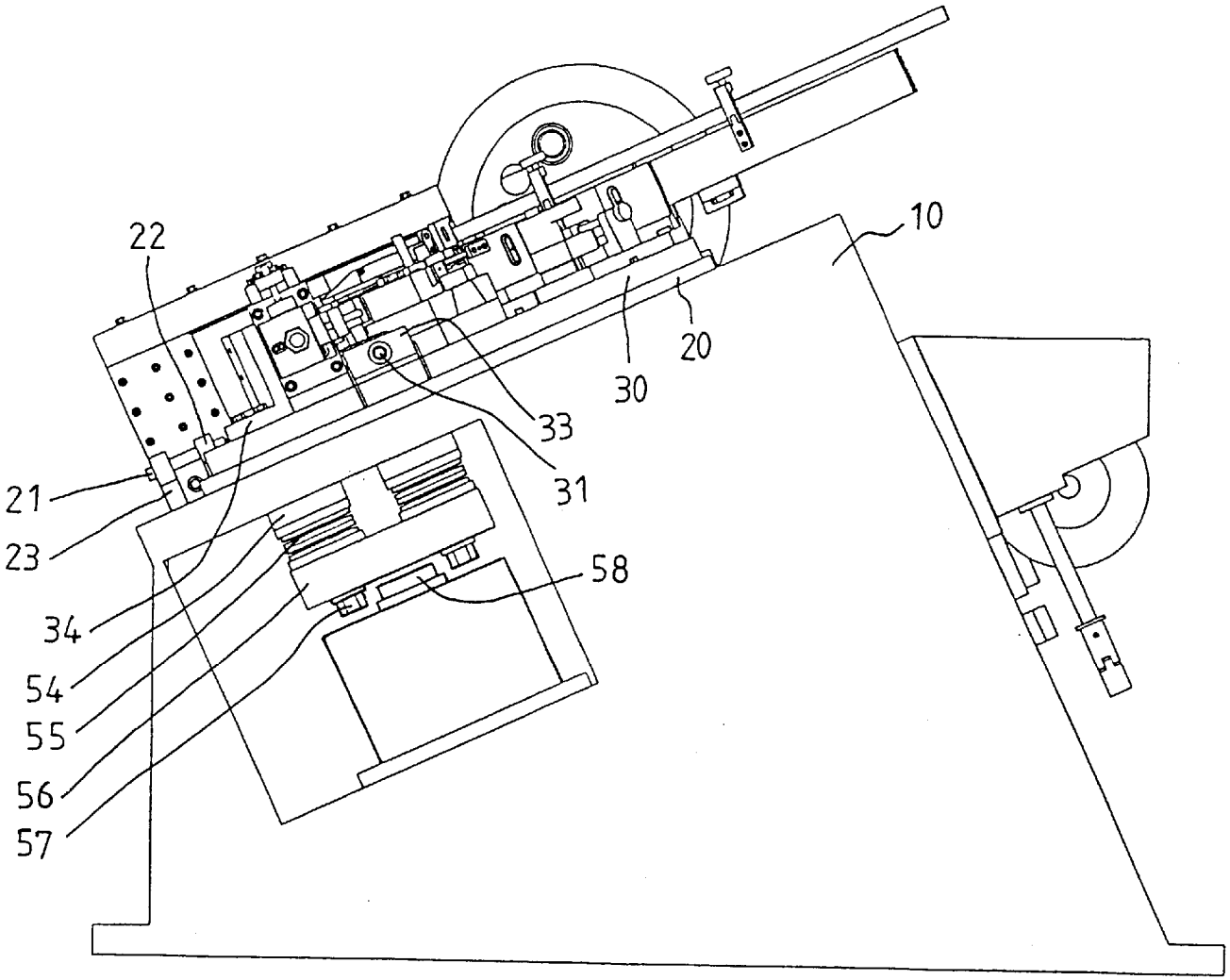
FIG. 5 shows a side view of the present invention.
Figure 6:
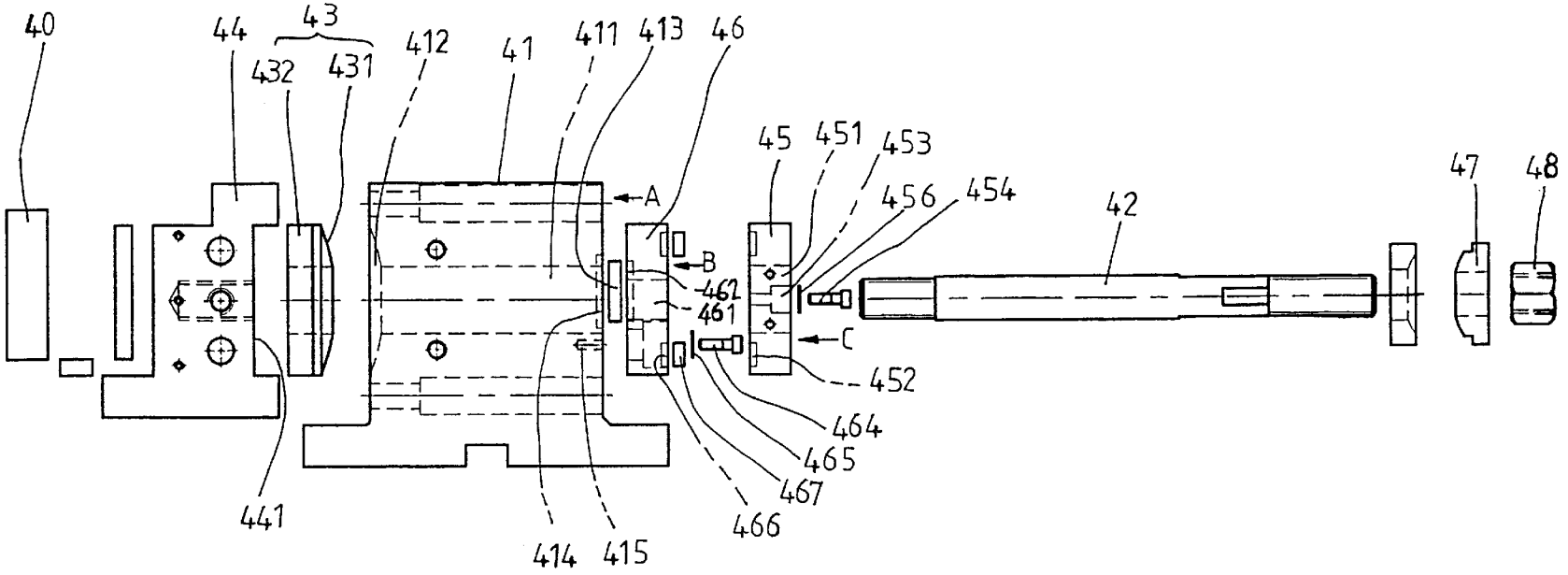
FIG. 6 shows a partial schematic view of the angle adjusting mechanism of the present invention.
Figure 9:
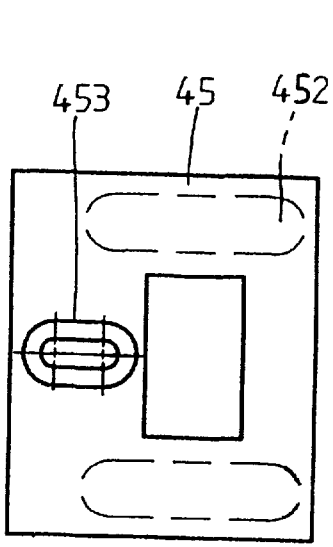
FIG. 9 shows a sectional view taken along the direction indicated by an arrow "C" as shown in FIG. 6.
Figure 8:
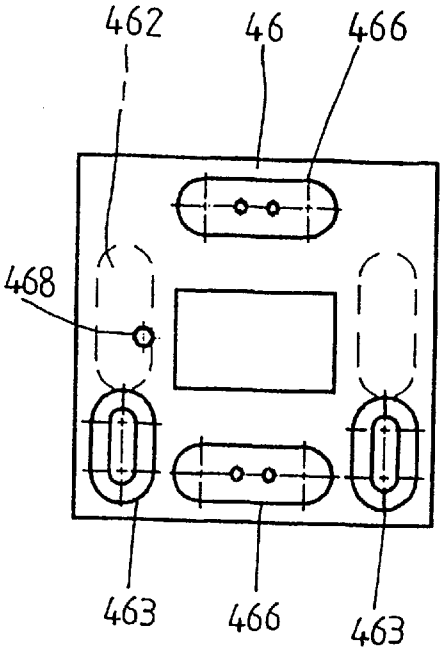
FIG. 8 shows a sectional view taken along the direction indicated by an arrow "B" as shown in FIG. 6.
Figure 7:
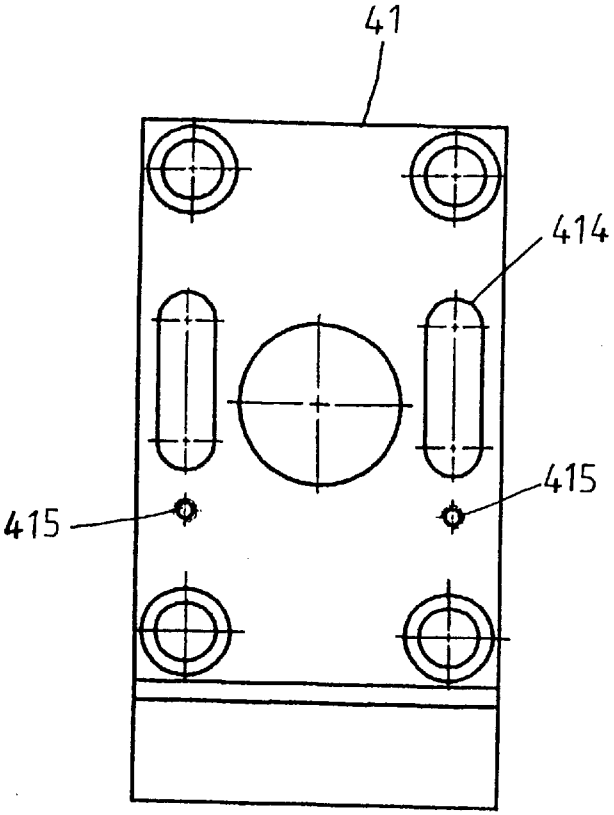
FIG. 7 shows a sectional view taken along the direction indicated by an arrow "A" as shown in FIG. 6.
Figure 10:
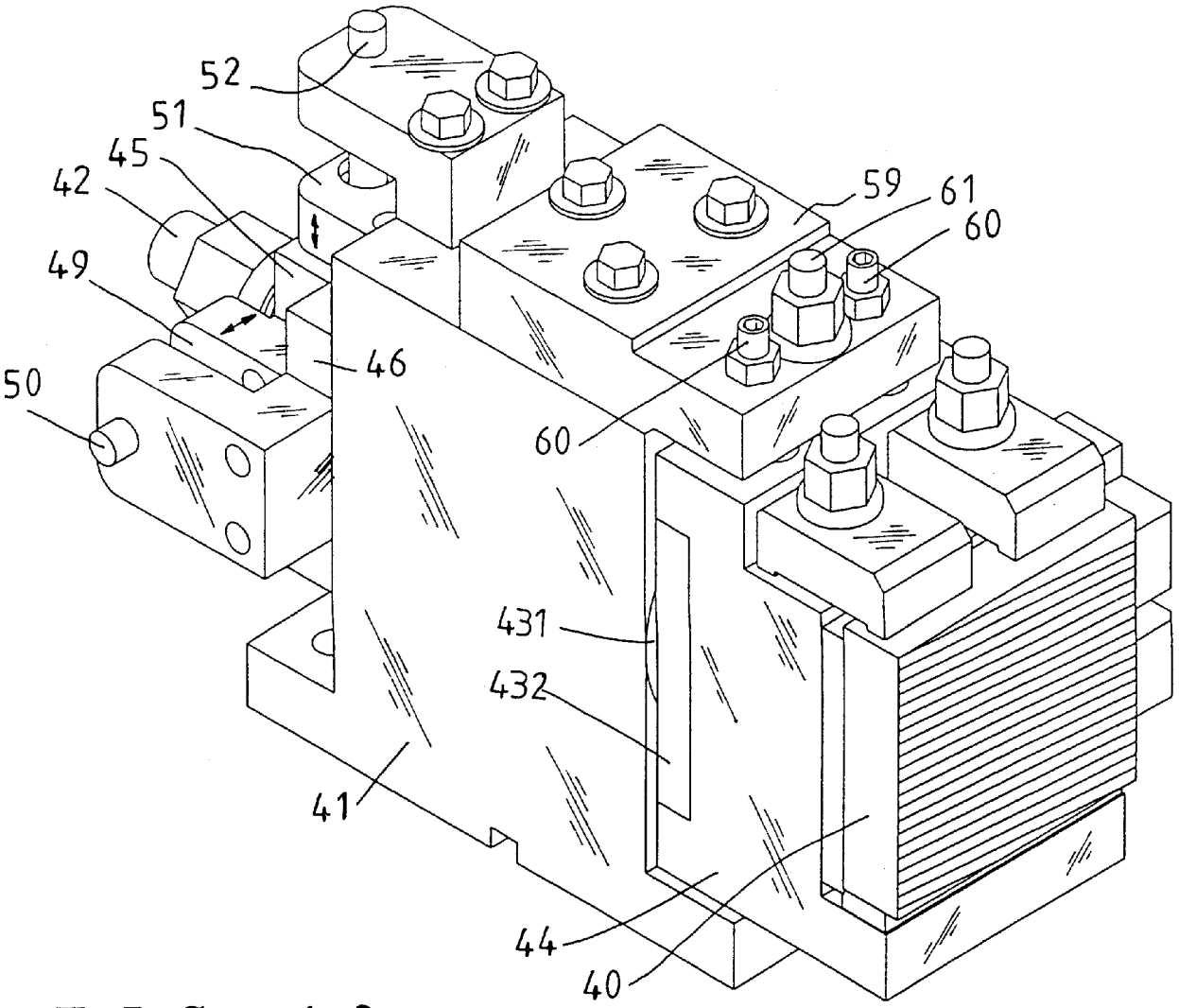
FIG. 10 shows a schematic view of the angle adjusting mechanism of the present invention.
Figure 11:
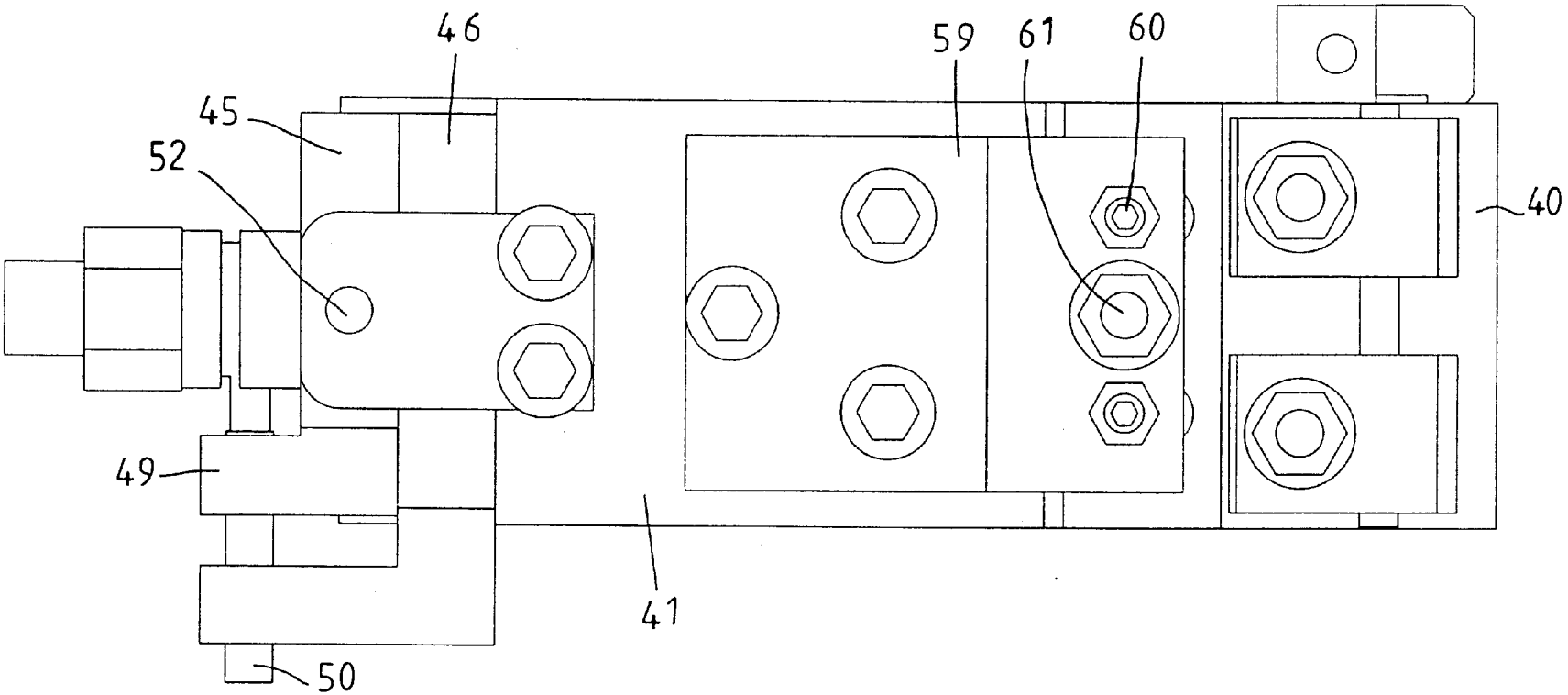
FIG. 11 shows a top view of the angle adjusting mechanism of the present invention.
Figure 12:
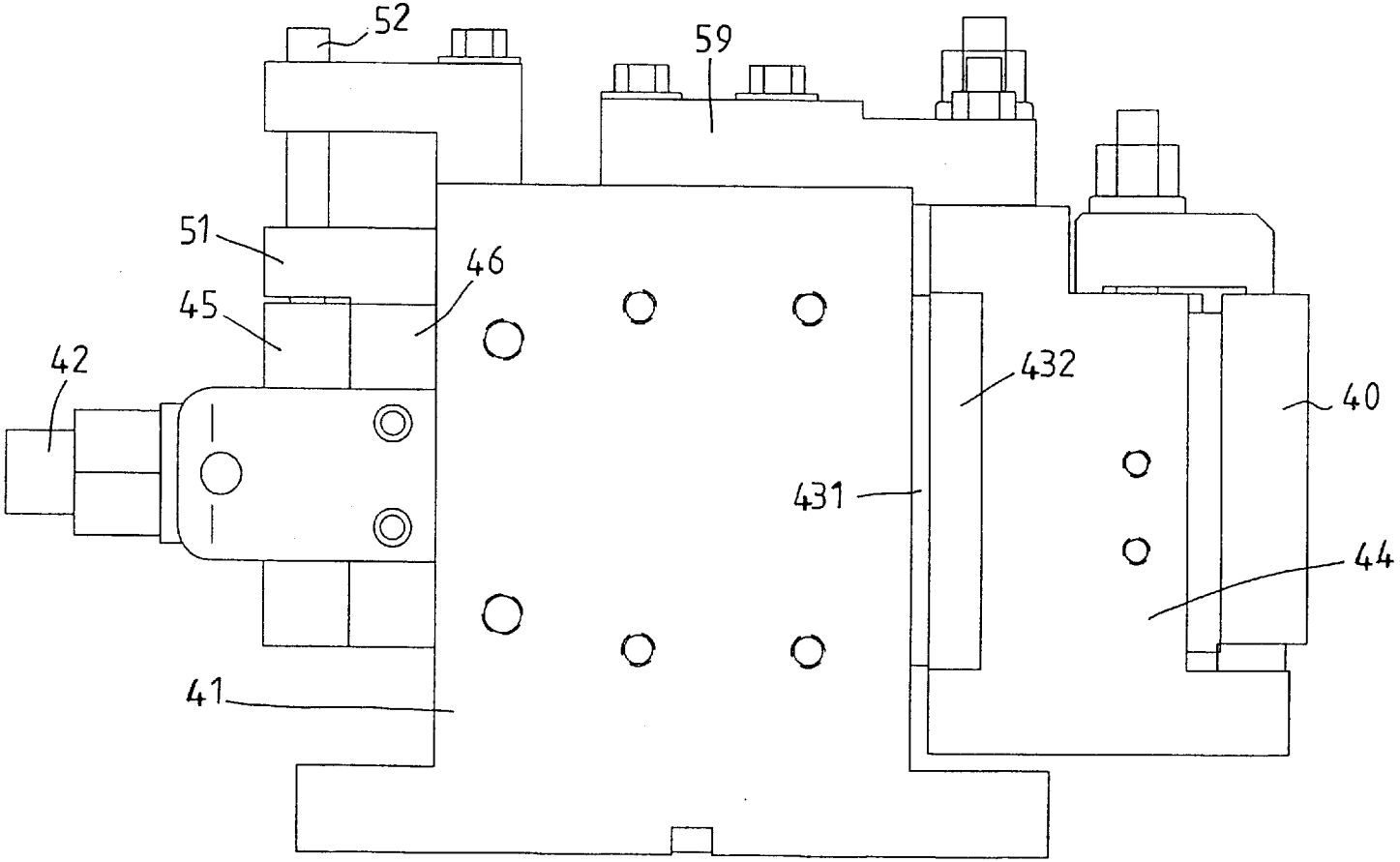
FIG. 12 shows a side view of the angle adjusting mechanism of the present invention.

As shown in FIGS. 4 and 5, a machine frame 10 of the present invention is provided in one side thereof with a movable mold 15, and in other side thereof with a first slide plate 20 which moves back and forth along a longitudinal slide rail. The first slide plate 20 is fastened with a fastening seat 22 of one end of an adjustment rod 21. The other end of the adjustment rod 21 is provided with a threaded seat 23 which is fastened with the machine frame 10. The first slide plate is pushed by the adjustment rod 21 to move back and forth along the machine frame 10. The first slide plate 20 is provided with a second slide plate 30 slidably mounted thereon such that the second slide plate 30 slides leftward and rightward along a horizontal slide rail which is mounted on the first slide plate 20. The fastening seat of one end of the adjustment rod 31 is fastened with the second slide plate 30. The second slide plate 30 is pushed by the adjustment rod 31 to displace leftward and rightward along the first slide plate 20. The second slide plate 30 is provided with an L-shaped plate 34 for fastening an angle adjusting mechanism of the fixed mold. As shown in FIG. 6, the rear seat 41 of the fixed mold 40 has a through hole 411 and a semispherical cavity 412 located at one end of the through hole 41 1. A threaded rod 42 is put through the through hole 411 and is then engaged with a semispherical body 43 having a spherical surface 431 which is received in the cavity 412. The semispherical body 43 has a tray surface 432 which is fitted into a slot 441 of the front seat 44. By means of the universal rotation of the semispherical body 43, the threaded rod 42 is pushed to enable the change in the angle of the fixed mold. In order to enhance the adjustment reliability of the threaded rod 42, the threaded rod 42 is engaged with a blind angle adjusting block 45 having a longitudinal slot 451, and with an inclination angle adjusting block 46 having a horizontal slot 461. The threaded rod 42 is fastened with a semispherical pad 47 and a nut 48. As shown in FIGS. 6, 7, and 8, the rear seat 41 is provided with a key slot 414 for fastening a guide block 413. The inclination angle adjusting block 46 is provided with a slide slot 462 for receiving the guide block 413, thereby enabling the inclination angle adjusting block 46 to slide linearly along the rear seat 41. In order to provide a force for joining the rear seat 41 with the inclination angle adjusting block 46, the inclination angle adjusting block 46 is provided with a stepped slot 463. A bolt 464 is engaged with the threaded hole 415 of the rear seat in conjunction with an elastic piece 465 such that the inclination angle adjusting block 46 is gently clamped and is therefore capable of sliding up and down. As shown in FIGS. 6, 8, and 9, the inclination angle adjusting block 46 is provided in other side thereof with a key slot 466 for fastening a guide block 467. In the meantime, the blind angle adjusting block 45 is provided with a slide slot 452 for receiving the guide block 467, thereby enabling the blind angle adjusting block 45 to slide horizontally along the inclination angle adjusting block 46. The blind angle adjusting block 45 is provided with a stepped slide slot 453. A blot 454 is engaged with the threaded hole 468 of the inclination angle adjusting block in conjunction with an elastic piece 456. The blind angle adjusting block 45 is not hampered to slide horizontally. After the completion of the assembly of the angle adjusting mechanism, the longitudinal slot 451 of the blind angle adjusting block 45 is used to push the threaded rod 42 to slide horizontally along the horizontal slot 461 of the inclination angle adjusting block 46. The horizontal slot 461 of the inclination angle adjusting block 46 is used to push the threaded rod 42 to slide up and down. As shown in FIGS. 10, 11, and 12, the fixed mold 40 is provided in the rear seat 41 with a press plate 59 pressing against the front seat 44 by an urging rod 60 and a pull rod 61. The blind angle adjusting block 45 is provided in one side thereof with a push plate 49. When the push plate 49 is pushed and pulled by the adjustment rod 50, the blind angle adjusting block 45 is actuated to slide horizontally so as to adjust the blind angle of the fixed mold 40. The inclination angle adjusting block 46 is provided with a push plate 51. When the push plate 51 is pushed and pulled by the adjustment rod 52, the inclination angle adjusting block 46 is actuated to slide up and down so as to adjust the angle of inclination of the fixed mold 40.

As shown in FIG. 4, the first slide plate 20, the second slide plate 30, and the angle adjusting mechanism of the present invention are engaged in the linear displacement to attain the adjustments of the thread line split, the rolling depth, the blind angle, and the inclination angle. As a result, the rigidity of the present invention is greatly enhanced. The adjustment precision of the present invention is not compromised.

Figure 13:
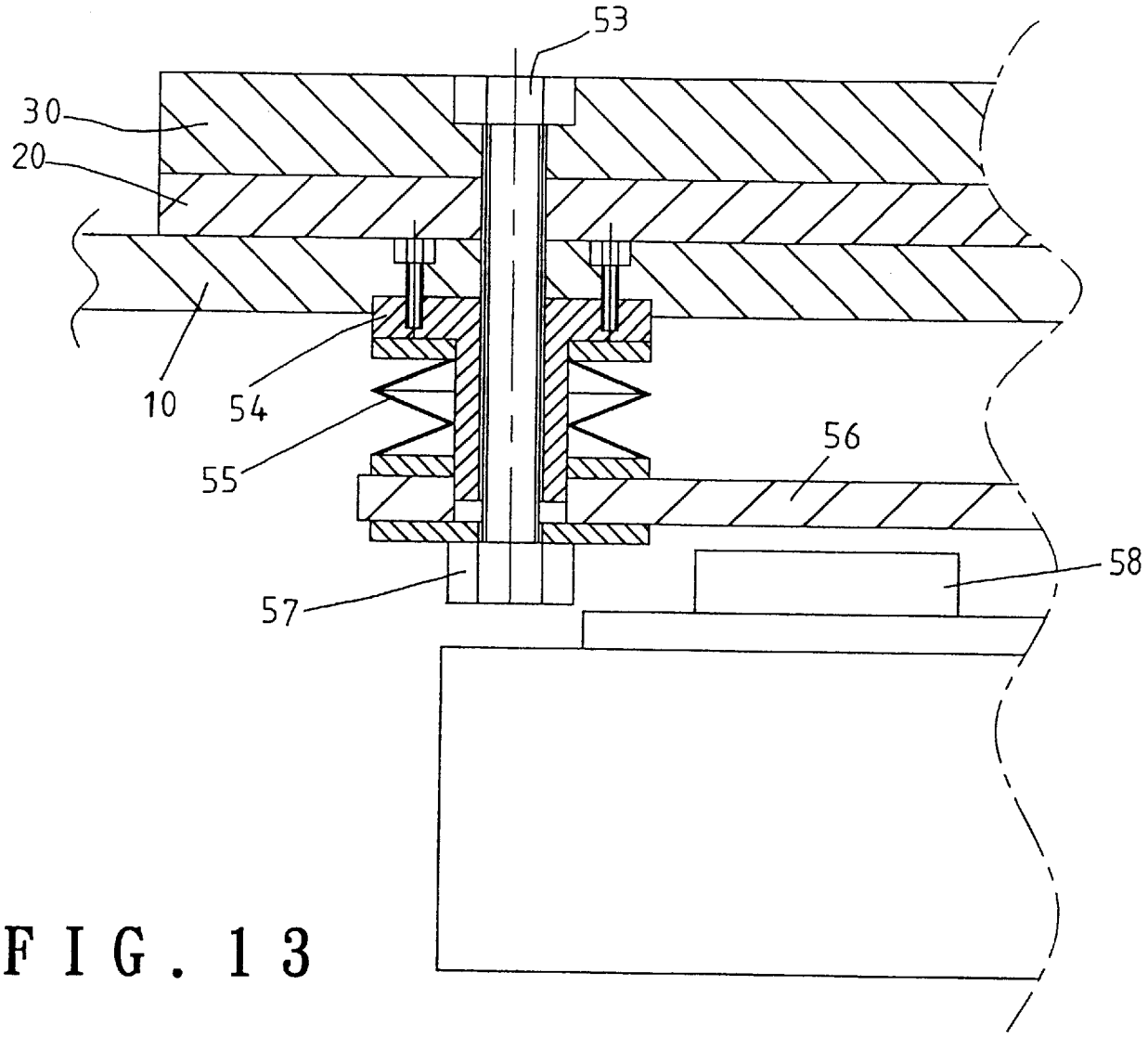
FIG. 13 shows a sectional schematic view of the locking mechanism of the present invention.

As shown in FIGS. 5 and 13, the mold locking mechanism of the present invention comprises the first slide plate 20, the second slide plate 30, and the threaded rod 53 which is provided with a fitting ring 54 having an elastic body 55 and is fastened by a press plate 56 and a nut 57. The first slide plate 20 and the second slide plate 30, and the machine frame 10 are kept in the locking state by the elastic force of the elastic body 55. A pressure cylinder 58 is disposed under the press plate 56. When the press plate 56 is urged by the pressure cylinder 58, the elastic body 55 is compressed. As a result, the threaded rod 53 is in the unlocking state such that the fixed mold can be adjusted.

What is claimed is:

1. A mold seat adjusting structure of a thread rolling machine, said mold seat adjusting structure comprising:

a machine frame;

a first adjustment rod having a fastening seat and a threaded seat which is fastened with said machine frame;

a first slide plate slidably mounted on a longitudinal slide rail such that said first slide plate is fastened with said fastening seat of said adjustment rod, and that said first slide plate is actuated by said first adjustment rod to slide along said longitudinal slide rail, said first slide plate having a horizontal slide rail;

a second slide plate slidably mounted on said horizontal slide rail of said first slide plate in conjunction with a second adjustment rod which is provided with a fastening seat and a threaded seat, said fastening seat being fastened with said first slide plate, said threaded seat being fastened with said second slide plate, whereby said second slide plate is driven by said second adjustment rod to slide along said horizontal slide rail of said first slide plate; and an angle adjusting mechanism fastened on said second slide plate and comprising:

a fixed mold having a rear seat and a front seat, said rear seat provided with a horizontal through hole, a cavity, a key slot, a guide block received in said key slot, and a press plate, said front seat having one end for locking said fixed mold, and other end provided with a threaded rod urging said front seat relative to said rear seat;

a semispherical body having a through hole, a spherical surface, and a tray surface, said semispherical body being disposed on said rear seat of said fixed mold such that said spherical surface of said semispherical body is received in said cavity of said rear seat of said fixed mold, and that said tray surface of said semispherical body is received in said other end of said front seat of said fixed mold;

said threaded rod fastened at one end thereof with said through hole of said rear seat of said fixed mold;

an inclination angle adjusting block provided with a horizontal slot, a threaded hole, a slide slot, and a key slot for receiving a guide block whereby said horizontal slot is engaged with said threaded rod such that said slide slot is engaged with said guide block of said rear seat of said fixed mold; and a blind angle adjusting block provided with a longitudinal slot, a slide slot, and a nut, said blind angle adjusting block being engaged with said threaded rod which is received in said longitudinal slot such that said slide slot is engaged with said guide block of said inclination angle adjusting block, and that said blind angle adjusting block slides leftward and rightward along said inclination angle adjusting block, and that said nut is engaged with said threaded rod.

2. The mold seat adjusting structure as defined in claim 1, wherein said angle adjusting mechanism is fastened with said second slide plate by an L-shaped plate.

3. The mold seat adjusting structure as defined in claim 1, wherein said inclination angle adjusting block of said angle adjusting mechanism is provided with a push plate whereby said push plate is pushed and pulled by an adjustment rod to enable said inclination angle adjusting block to slide up and down.

4. The mold seat adjusting structure as defined in claim 1, wherein said blind angle adjusting block is provided with a push plate whereby said push plate is pushed and pulled by an adjustment rod to enable said blind angle adjusting block to slide leftward and rightward.

5. The mold seat adjusting structure as defined in claim 1, wherein said inclination angle adjusting block is provided with a stepped slot and is fastened with said rear seat of said fixed mold by a bolt and an elastic pad whereby said bolt is engaged with a threaded hole of said rear seat of said fixed mold.

6. The mold seat adjusting structure as defined in claim 1, wherein said blind angle adjusting block is provided with a stepped slot and is fastened with said inclination angle adjusting block by a bolt and an elastic pad whereby said bolt is engaged with said threaded hole of said inclination angle adjusting block.

7. The mold seat adjusting structure as defined in claim 1, further comprising a mold locking mechanism, said mold locking mechanism comprising:

a threaded rod penetrating said second slide plate, said first slide plate, and said machine frame such that one end of said threaded rod is jutted out of said machine frame;

a fitting ring fitted over said one end of said threaded rod and provided with an elastic pad fitted thereover;

a press plate fastened with said threaded rod such that said press plate presses against said elastic pad; and a pressure cylinder disposed under said press plate to compress said elastic pad to enable said threaded rod to be relieved of the locking state.

* * * * *